US012258978B2

(12) United States Patent
Reilly et al.

(10) Patent No.: US 12,258,978 B2
(45) Date of Patent: Mar. 25, 2025

(54) FAN ASSEMBLY WITH A REMOVABLE FILTER ASSEMBLY

(71) Applicant: Dyson Technology Limited, Wiltshire (GB)

(72) Inventors: Philip Tennison Reilly, Gloucester (GB); Ben Thomas Edmonds, Swindon (GB)

(73) Assignee: Dyson Technology Limited, Wilthshire (GB)

( * ) Notice: Subject to any disclaimer, the term of this patent is extended or adjusted under 35 U.S.C. 154(b) by 0 days.

(21) Appl. No.: 18/572,453

(22) PCT Filed: May 25, 2022

(86) PCT No.: PCT/GB2022/051317
§ 371 (c)(1),
(2) Date: Dec. 20, 2023

(87) PCT Pub. No.: WO2022/269223
PCT Pub. Date: Dec. 29, 2022

(65) Prior Publication Data

US 2024/0309889 A1 Sep. 19, 2024

(30) Foreign Application Priority Data

Jun. 22, 2021 (GB) ..... 2108929.7

(51) Int. Cl.
*F04D 29/70* (2006.01)
*F04D 25/08* (2006.01)
*F04D 29/44* (2006.01)

(52) U.S. Cl.
CPC ..... *F04D 29/703* (2013.01); *F04D 25/08* (2013.01); *F04D 29/441* (2013.01)

(58) Field of Classification Search
CPC ..... F04D 29/703; F04D 25/08; F04D 29/441
See application file for complete search history.

(56) References Cited

U.S. PATENT DOCUMENTS

2003/0132153 A1 7/2003 Jelten
2011/0236219 A1* 9/2011 Fitton ..... F04F 5/16 416/247 R (Continued)

FOREIGN PATENT DOCUMENTS

CN 110529436 A 12/2019
CN 110541845 A 12/2019

(Continued)

OTHER PUBLICATIONS

Examination Report received for GB Application No. 2108929.7, mailed on Oct. 10, 2023, 3 pages.

(Continued)

*Primary Examiner* — Aaron R Eastman
(74) *Attorney, Agent, or Firm* — Tucker Ellis LLP

(57) ABSTRACT

A fan assembly, including a fan body including an inlet surface defining an air inlet. A motor-driven impeller contained within the fan body generates an airflow. A filter assembly is arranged to removably engage with the fan body and to cover at least a portion of the inlet surface when engaged with the fan body. The filter assembly includes a filter and a housing for the filter, the housing being provided with a filter retention assembly for releasably retaining the filter in the housing, and a user interface for actuating the filter retention assembly to release the filter from the housing. Upon actuation of the filter retention assembly via the user interface, the filter is free to slide relative to the housing. Preferably, the user interface is positioned on the housing.

15 Claims, 9 Drawing Sheets

(56) References Cited

U.S. PATENT DOCUMENTS

| | | | | |
|---|---|---|---|---|
| 2015/0052864 | A1 | 2/2015 | Jackson | |
| 2019/0168150 | A1* | 6/2019 | Biltcliffe | B01D 46/58 |
| 2019/0168151 | A1* | 6/2019 | Biltcliffe | F04D 25/08 |
| 2022/0397120 | A1* | 12/2022 | Ying | F04D 25/0606 |

FOREIGN PATENT DOCUMENTS

| | | | |
|---|---|---|---|
| CN | 110778535 | A | 2/2020 |
| CN | 110821866 | A | 2/2020 |
| CN | 210531252 | U | 5/2020 |
| CN | 111365300 | A | 7/2020 |
| EP | 1931443 | A2 | 6/2008 |
| GB | 0823648 | A | 11/1959 |
| JP | 03-098609 | A | 4/1991 |
| JP | 2001-104716 | A | 4/2001 |
| JP | 6571566 | B2 | 9/2019 |
| WO | 2007/038542 | A2 | 4/2007 |
| WO | 2022/269223 | A1 | 12/2022 |

OTHER PUBLICATIONS

International Search Report and Written Opinion received for PCT Patent Application No. PCT/GB2022/051317, mailed on Aug. 31, 2022, 9 pages.

Search Report received for GB Application No. 2108929.7, mailed on Nov. 26, 2021, 2 pages.

* cited by examiner

FAN ASSEMBLY WITH A REMOVABLE FILTER ASSEMBLY

CROSS-REFERENCE TO PRIOR APPLICATIONS

This application is a § 371 National Stage Application of PCT International Application No. PCT/GB2022/051317 filed May 25, 2022, which claims the priority of United Kingdom Application No. 2108929.7, filed Jun. 22, 2021, each of which are herein incorporated by reference in their entirety.

FIELD OF THE INVENTION

The present invention relates to a fan assembly.

BACKGROUND OF THE INVENTION

Some domestic fans employ the use of one or more filters to filter and/or purify airflow before it is emitted from the fan. These filters may need replacing by a user of the fan during the lifetime of the fan.

SUMMARY OF THE INVENTION

According to a first aspect of the present invention there is provided a fan assembly comprising a fan body comprising an inlet surface defining an air inlet, a motor-driven impeller contained within the fan body and arranged to generate an airflow, and a filter assembly arranged to removably engage with the fan body and to cover at least a portion of the inlet surface when engaged with the fan body. The filter assembly comprises a filter and a housing for the filter, the housing being provided with a filter retention assembly for releasably retaining the filter in the housing, and a user interface for actuating the filter retention assembly to release the filter from the housing. Upon actuation of the filter retention assembly via the user interface, the filter is free to slide relative to the housing.

The fan assembly according to the first aspect of the present invention may be advantageous in that the filter may be disengaged from the housing by applying a direct force to only the user interface. In particular, upon actuation of the filter retention assembly via the user interface, the filter is free to slide relative to the housing. The filter, which may be dirty, may therefore be removed and disposed of without the need for a user to contact the filter.

The fan assembly according to the first aspect of the present invention may be advantageous in that sliding of the filter relative to the housing upon actuation of the filter retention assembly via the user interface provides a simple and intuitive mechanism for the user to disengage the filter from the housing. That is, the user is not required to directly push, pull or apply any other force to the filter itself to cause the filter to slide relative to the housing.

Upon actuation of the filter retention assembly via the user interface, the filter may be arranged to slide under gravity relative to the housing. For example, the filter may slide through a recess in an underside of the housing to disengage the filter from the housing. This may allow a user to hold the filter assembly above a bin, for example, and actuate the filter retention mechanism via the user interface such that the filter falls under gravity into the bin without the user contacting the filter.

The filter may be slidable relative to the housing along a length of the filter. For example, in a direction extending from a top edge to a bottom edge of the filter as viewed when the fan assembly is in use. This may help to enable the filter to slide relative to the housing upon actuation of the filter retention assembly via the user interface.

The filter may comprise a particulate filter media for removing particulates from the air flow prior to passing through the motor-driven impeller. This may protect the impeller from debris and dust that may be drawn into the fan assembly and which may damage the fan assembly and helps to ensure that air emitted from the fan assembly is free from particulates. In addition, this may serve to remove various chemical substances from the airflow that could potentially be a health hazard, so that the air emitted from the fan assembly is purified.

The housing may fully cover the filter such that the filter is encased between the housing and the fan body when the filter assembly is engaged with the fan body. This may help protect the filter when the filter assembly is engaged with the fan body.

The filter may cover substantially all of the air inlet. This may help to prevent unfiltered airflow from reaching the air inlet during use of the fan assembly, and thus helps to ensure that filtered air is emitted from the fan assembly in use.

The user interface may be positioned on an inner surface of the housing. For example, the inner surface may face the fan body when the filter assembly is engaged with the fan body such that the user interface is hidden from view. This may help to prevent accidental release of the filter from the housing during use of the fan assembly or during removal of the filter assembly from the fan body.

The user interface may be positioned on a surface of the housing that is inaccessible to the user when the filter assembly is engaged with the fan body. This may help to prevent accidental release of the filter from the housing during use of the fan assembly or during removal of the filter assembly from the fan body.

The fan assembly may comprise a nozzle mounted on and supported by the fan body, the nozzle being arranged to receive the airflow from the fan body and to emit the airflow from the fan assembly. For example, the user interface may be positioned such that it is covered by the nozzle when the nozzle is mounted on the fan body.

The fan assembly may be arranged such that the when the nozzle is mounted on the fan body, the filter assembly cannot slide relative to the fan body to disengage the filter assembly from the fan body. This may help to prevent inadvertent movement or removal of the filter assembly during use of the fan body, which may in turn help to ensure that unfiltered air cannot reach the air inlet. This may also negate the need for a mechanism to retain the filter assembly in position relative to the fan body.

The filter assembly may comprise two filter release assemblies and two corresponding user interfaces. The two user interfaces may be disposed at the same end of the housing as each other. For example, the filter assembly may be circular in cross-section and comprise two filter release assemblies and two user interfaces, the user interfaces being diametrically opposite one another at an upper end of the filter assembly, the upper end being the highest end of the filter assembly when engaged with the fan body. This may help to provide a simple way for a user to remove the filter from the housing by applying simultaneous force to the two user interfaces using two hands. By applying substantially equal and opposing forces to the two user interfaces to release the filter, the filter is less likely to tilt relative to the housing and thus inadvertently and disadvantageously catch against the housing during the sliding of the filter relative to the housing.

The filter retention assembly may be movable between a locked position in which the filter is retained in the housing and an unlocked position in which the filter is free to slide relative to the housing. The filter retention assembly may be biased towards the locked position, for example by a spring. This may help to enable automatic retention of the filter in the housing upon insertion of the filter into the housing by a user.

The filter retention assembly may comprise a catch arranged to engage the filter when the filter retention assembly is in the locked position and to disengage from the filter upon actuation via the user interface. For example, the filter may comprise a filter medium and a filter frame at an edge of the filter medium, and the filter frame may be provided with a rim that is arranged to be engaged by the filter retention assembly. This may provide a simple mechanism for retaining and releasing the filter from the housing, which may in turn help to reduce cost and complexity in manufacturing and assembly.

The user interface may be a mechanical interface such as, for example, a push button, handle, toggle or switch. This provides a simple, easily manufacturable user interface.

The filter assembly may be arranged to substantially surround all of the fan body when the filter assembly is engaged with the fan body. This may help to prevent unfiltered air from entering the air inlet and increase the area of the filter. The filter assembly may have a closed cross-sectional shape and be arranged to be concentric with the fan body when engaged with the fan body.

The fan body may be substantially cylindrical, for example circular or oval-shaped in cross-section. The filter assembly may extend circumferentially around the fan body when the filter assembly is engaged with the fan body. For example, the inlet surface may comprise a curved surface and the filter assembly may extend around the curved surface such that the filter covers the curved surface and thus the air inlet. Providing a curved inlet surface may help to provide a more even load to the motor-driven impeller.

The fan body may be non-cylindrical, for example rectangular or hexagonal, and the filter assembly may cover at least two sides of the fan body. This may help to prevent rotation of the filter assembly relative to the fan body.

The filter assembly may extend more than 180 degrees around the fan body when the filter assembly is engaged with the fan body. This may ensure that the filter assembly can be engaged with the fan body only by sliding the filter assembly relative to the fan body, rather than pushing the filter assembly against a surface of the fan body, which may help to assure proper assembly of the fan assembly and help to prevent damage to the filter during assembly.

The filter assembly may have an inner cross-sectional shape that corresponds to an outer cross-sectional shape of the fan body. This may help to ensure a close fit between the filter assembly and the fan body when the filter assembly is engaged with the fan body, which may help to prevent unfiltered air reaching the air inlet.

The filter assembly may be tubular, for example such that the filter assembly substantially surrounds all of the fan body when the filter assembly is engaged with the fan body. This may help to prevent unfiltered air from entering the air inlet and increase the area of the filter.

The filter may substantially surround the fan body when the filter assembly is engaged with the fan body. This may help to provide a more even load to the motor-driven impeller.

The filter may be slidable relative to the housing in a direction parallel to a longitudinal axis of the filter assembly. The longitudinal axis of the filter assembly being parallel to, for example co-axial with, a central axis of the fan body when the filter assembly is engaged with the fan body. The central axis of the fan body is defined as an axis passing from a top to a bottom of the fan body and through a centre of the fan body when the fan body is oriented for correct use of the fan assembly. This may allow the filter to slide from the housing upon actuation of the filter release assembly via the user interface, without a need to change an orientation of the filter assembly, which may help to prevent particles held on the filter from being dislodged during removal of the filter from the housing. This may also, for example, allow a user to place a filter on a surface and slide the housing over the filter until the filter is retained by the filter retaining assembly, thereby allowing a simple method for replacing the filter in the filter assembly.

The filter assembly may be slidable relative to the fan body in a direction parallel to the central axis of the fan body to disengage the filter assembly from the fan body. This may allow a user to lift the filter assembly from the fan body without a need to change an orientation of the filter assembly, which may help to prevent particles held on the filter from being dislodged during removal of the filter assembly from the fan body.

The fan body may comprise a radial flange at a lower end of the fan body, the lower end being the lowest end of the fan body when the fan body is in use. The filter assembly abuts the radial flange when the filter assembly is engaged with the fan body. The radial flange may thus act as a stop for the filter assembly to ensure the filter assembly and fan body are positioned correctly with respect to one another.

The housing may comprise a plurality of apertures to allow airflow to pass through the housing and the filter. This may help to ensure that only filtered air reaches the air inlet. The apertures may each be of equal size and/or equally spaced from one another. This may help to provide a more even load on the motor-driven impeller. The plurality of apertures may be sized to prevent larger particles from passing through the housing and blocking, or otherwise damaging, the filter.

The fan assembly may comprise a further filter releasably attached to the fan assembly to cover the inlet surface. The filter assembly may be arranged to cover the further filter such that the filter is positioned upstream of the further filter. For example, the further filter may be releasably attached to the fan body or may be releasably attached to an inner surface of the filter assembly. This may help to provide additional air filtration before airflow reaches the air inlet. This may also allow for the filter and the further filter to be independently replaced by a user.

The further filter may be a filter assembly, for example comprising one or more flexible filter media and at least two engagement elements for releasably attaching the further filter to the fan assembly. The filter assembly may be furlable, which should be understood to mean that the filter assembly can be, for example, rolled/unrolled, folded/unfolded etc. by a user without permanently deforming the filter assembly. This may allow the further filter to be retained over the inlet surface in an at least partially unfurled state, allowing the further filter to conform to a shape of the fan body.

The further filter may comprise a carbon filter, which may filter odours or volatile organic compounds from the airflow. This may help to provide a more purified airflow emitted from the fan assembly in use.

According to a second aspect of the present invention there is provided a filter assembly suitable for use with a fan assembly, the filter assembly comprising a filter and a housing for the filter, the housing being provided with a retention assembly for releasably retaining the filter in the housing and a user interface for actuating the filter retention assembly to release the filter from the housing, and wherein, upon actuation of the filter retention assembly via the user interface, the filter is free to slide relative to the housing.

Optional features of aspects of the present invention may be equally applied to other aspects of the present invention, where appropriate.

DETAILED DESCRIPTION OF THE INVENTION

There will now be described a fan assembly comprising one or more filter assemblies and mechanisms for retaining and releasing the filter assemblies that provide several advantages over those of conventional fan assemblies. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow.

Figure 1:
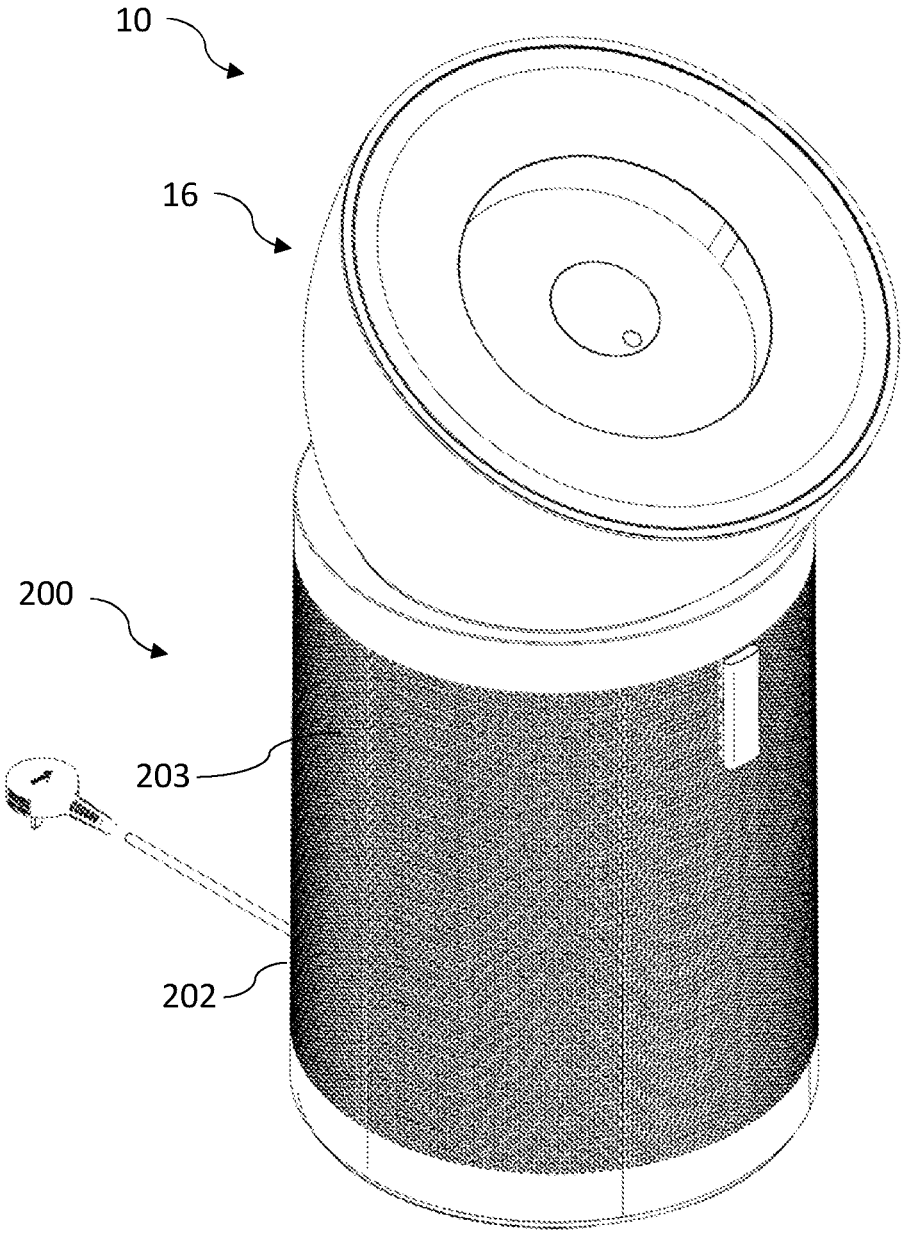
FIG. 1 is an isometric view illustrating a fan assembly according to the present invention.
Figure 2:
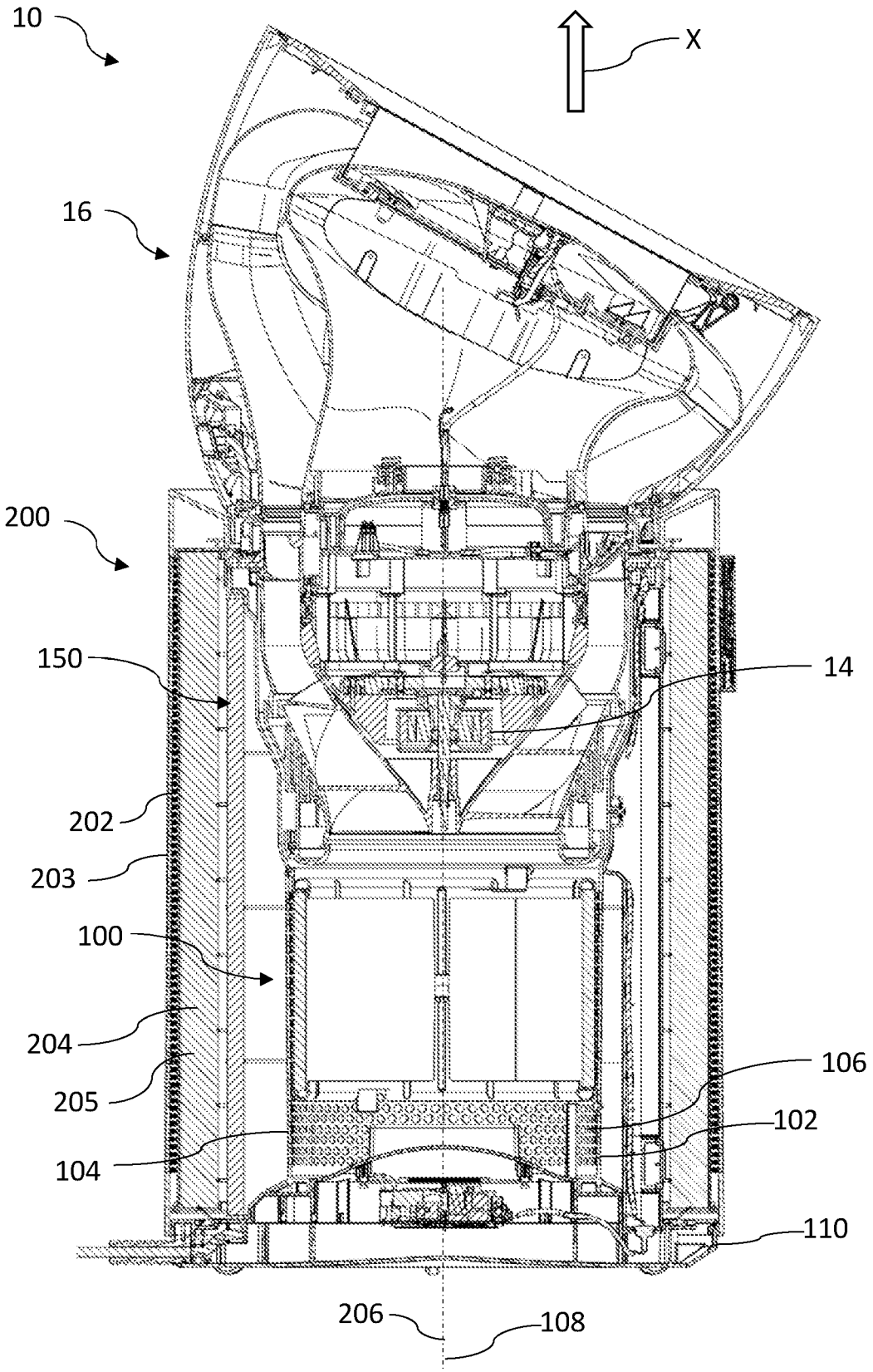
FIG. 2 is a sectional side view through the fan assembly of FIG. 1.

A fan assembly according to the present invention, generally designated 10, is shown schematically in FIG. 1 and in cross-section in FIG. 2.

The fan assembly 10 comprises a fan body 100, a motor-driven impeller 14 contained within the fan body 100 and arranged to generate an airflow, and a nozzle 16 mounted on and supported by the fan body 100. The nozzle 16 is arranged to receive the airflow from the fan body 100 and to emit the airflow from the fan assembly 10.

The fan body 100 comprises an inlet surface 102 defining an air inlet 104. In the embodiment shown in FIGS. 1 and 2, the inlet surface 102 is a curved surface extending around the cylindrical fan body 100. The air inlet 104 comprises an array of apertures 106 formed in the inlet surface 102, which in this instance surround the fan body to provide a 360-degree air inlet 104.

Figure 3:
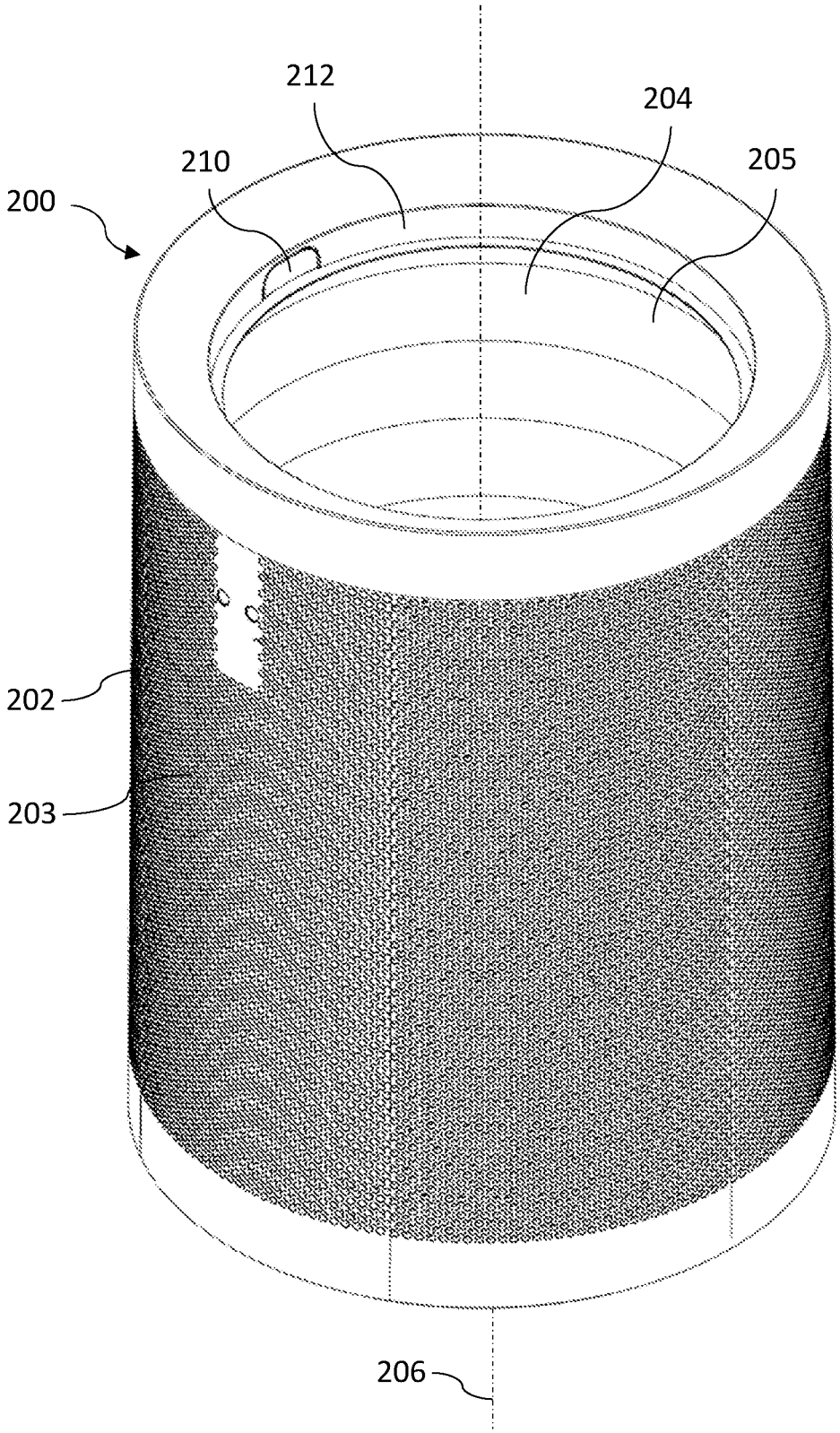
FIG. 3 is an isometric view of a filter assembly of the fan assembly of FIG. 1.

The fan assembly 10 comprises a filter assembly 200 surrounding the fan body 100 when engaged with the fan body 100. The filter assembly 200 is arranged to removably engage with the fan body 100 and to cover the inlet surface 102 when engaged with the fan body 100. FIG. 3 shows an isometric view of the filter assembly 200. The filter assembly 200 is tubular and is arranged to be concentric with the fan body 100 when engaged with the fan body 100 such that it surrounds the fan body 100 through 360 degrees. The filter assembly 200 has an inner cross-sectional shape that corresponds to an outer cross-sectional shape of the fan body 100, which in this embodiment is circular.

The filter assembly 200 is arranged to slidably engage with the fan body 100. That is, the filter assembly 200 is placed over the fan body 100 by a user and allowed to slide downwards to cover the inlet surface 102. A central axis 108 of the fan body 100 is co-axial with a longitudinal axis 206 of the filter assembly 200 when the filter assembly is engaged with the fan body 100 and the filter assembly 200 slides in a direction (denoted by arrow X in FIG. 2) parallel to the central axis 108 to engage the filter assembly 200 with the fan body 100.

The fan assembly 10 is arranged such that the when the nozzle 16 is mounted on the fan body 100, the filter assembly 200 cannot slide relative to the fan body 100 to disengage the filter assembly 200 from the fan body 100.

The filter assembly 200 comprises a filter 204 and a housing 202 for the filter 204. The filter 204 comprises a particulate filter medium 205 arranged to filter out particulates from the airflow generated by the motor-driven impeller 14 before the particulates reach the air inlet 104. The filter 204 further comprises a filter frame 216 covering the edges of the filter media 205.

The fan body 100 is provided with sealing elements (not shown), which contact surfaces of the filter assembly 200 when the filter assembly 200 is disposed on the fan body 100.

The sealing elements may contact surfaces of the filter frame 216. The sealing elements help to prevent air from passing around the filter media 205 to the air inlet 104.

The housing 202 is substantially cylindrical and is arranged to cover the filter 204, which is also substantially cylindrical, such that when the filter assembly 200 is engaged with the fan body 100, the filter 204 and housing 202 surround the inlet surface 102 and the filter 204 is encased between the housing 202 and the fan body 100. The housing 202 comprises a plurality of apertures 203 to allow airflow to pass through the housing 202 to the filter 204.

Figure 4:
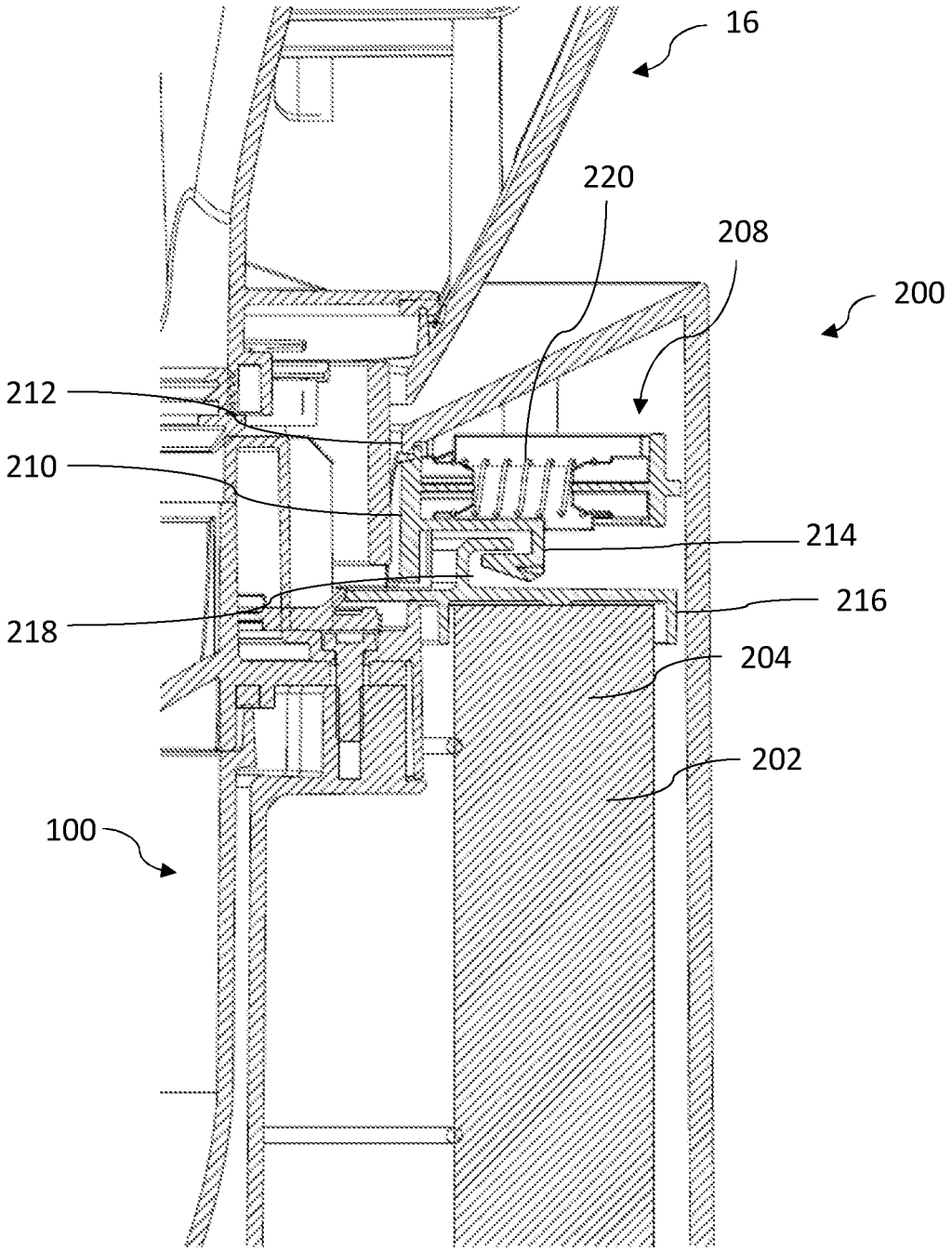
FIG. 4 is a sectional side view of a release mechanism of the fan assembly of FIG. 1.
Figure 5:
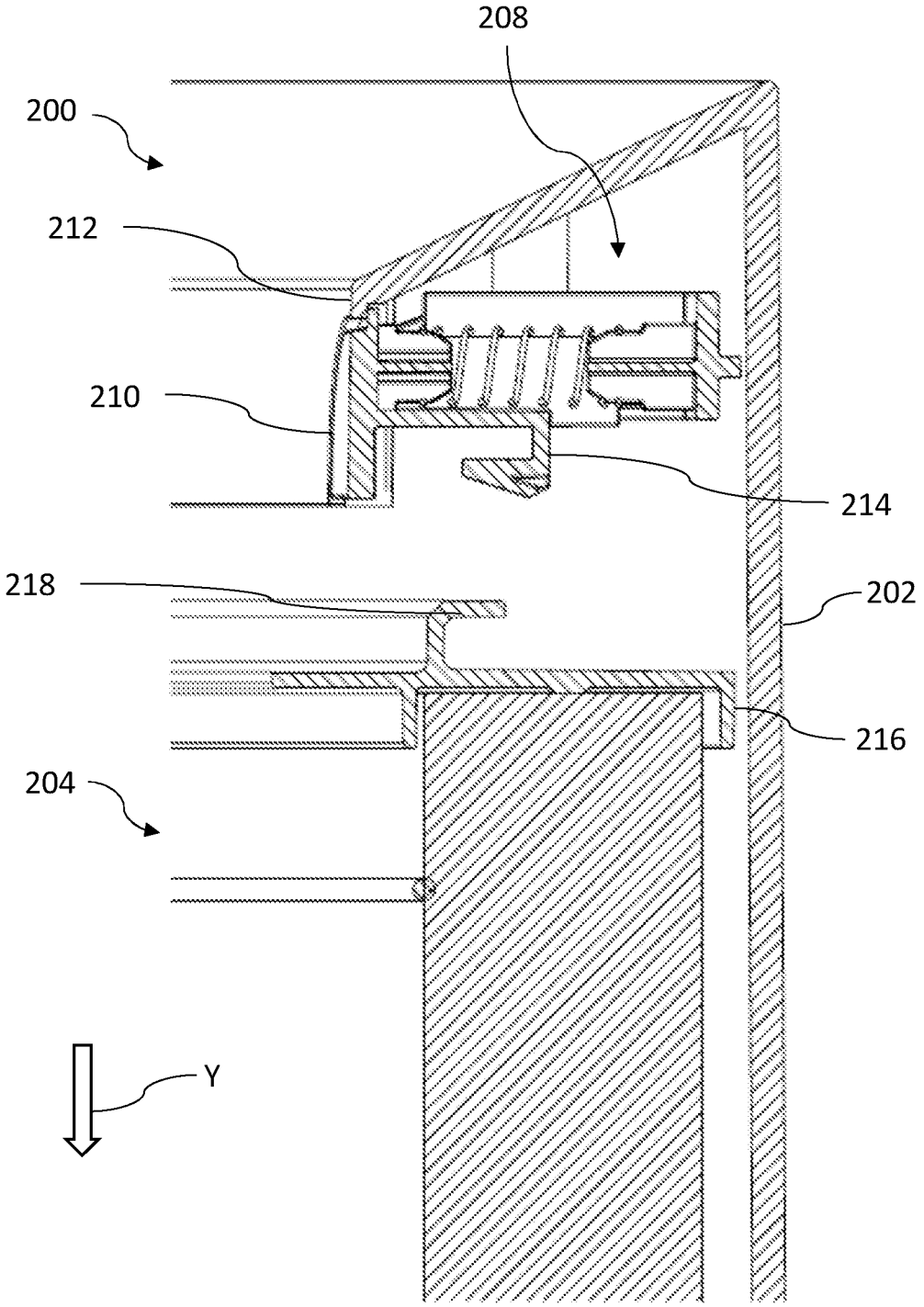
FIG. 5 is a sectional side view of the release mechanism of FIG. 4, with the filter assembly separated from the fan body and the filter separated from the housing.

During use of the fan assembly 10, the filter 204 collects particulates and the filtration performance of the filter 204 may degrade over time. The filter 204 may therefore be removed and replaced or cleaned. As best shown in FIGS. 4 and 5, the housing 202 is provided with two filter retention assemblies 208 for releasably retaining the filter 204 in the housing 202, and two user interfaces 210 for actuating the filter retention assembles 208 to release the filter 204 from the housing 202. The two user interfaces 210 are disposed at the same end of the housing 202 as each other, and at diametrically opposite sides of the housing 202. It will be understood that other embodiments may include only one filter retention assembly 208 and one user interface 210, or more than two filter retention assemblies 208 and user interfaces 210, and that the user interfaces 210 may be positioned at any suitable position on the housing 202.

The user interface 210 is a button positioned on the housing 202, such that a user does not need to touch the filter 204 to depress the button and release the filter 204 from the housing 202. The user interface 210 is inaccessible by a user when the filter assembly 200 is engaged with the fan body 100. In this embodiment, the nozzle 16 blocks the user interface 210 from view when mounted on the fan body 100 to prevent inadvertent release of the filter 204 during use of the fan assembly 10, as best shown in FIGS. 2 and 4. The user interface 210 is positioned on an inner surface 212 of the housing 202 such that the user interface 210 cannot be operated when the filter assembly 200 is engaged with the fan body 100. It will be understood that the user interface 210 could take any other suitable form for a user to actuate the filter retention assembly 208, such as a switch or handle.

The filter retention assembly 208 is movable between a locked position, as shown in FIG. 4, in which the filter 204 is retained to the housing 202, and an unlocked position, in which the filter 204 is free to slide relative to the housing 202 upon release from the filter retention assembly 208.

Figure 6:
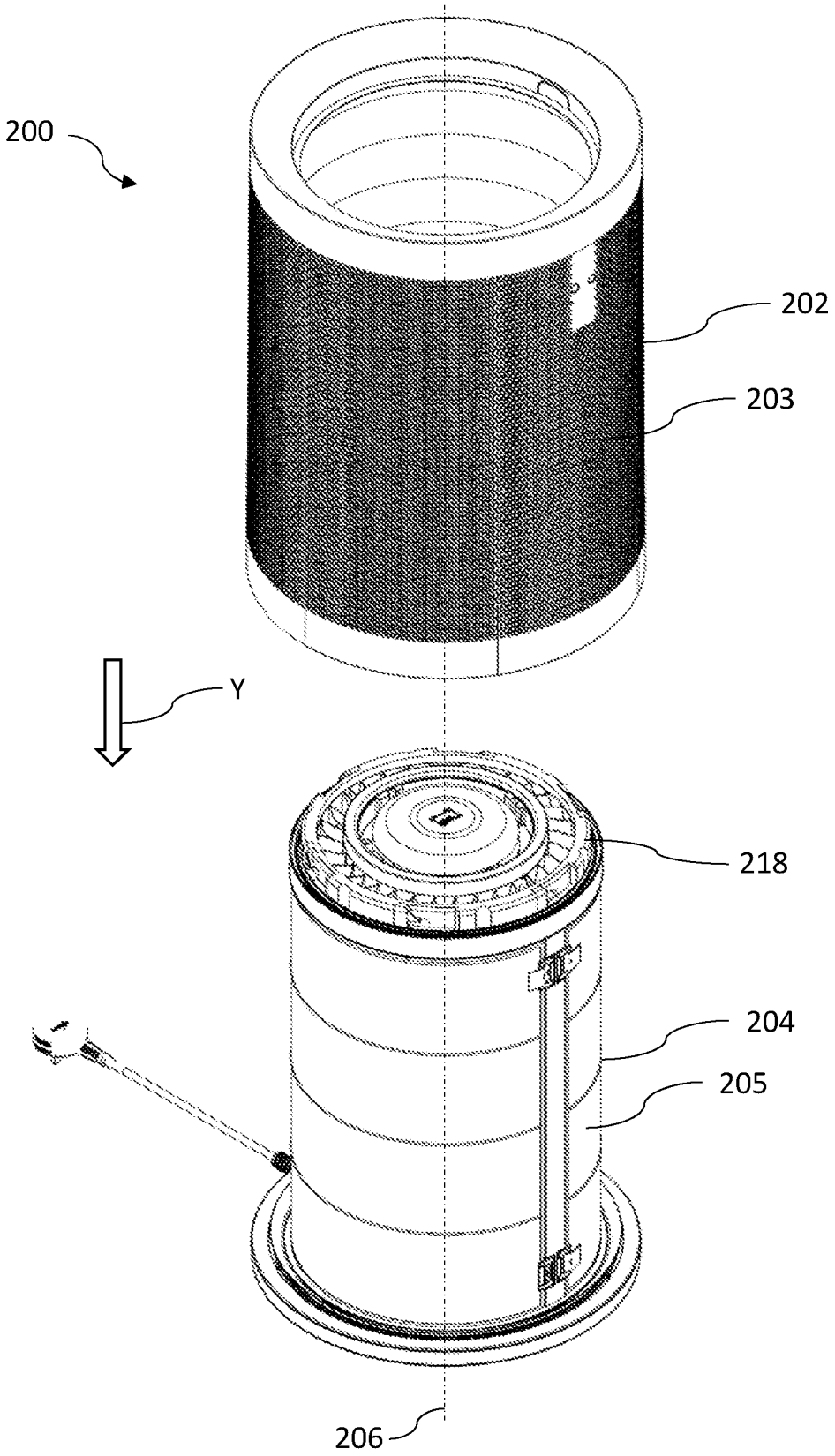
FIG. 6 is an isometric view of the filter assembly of FIG. 3 with the filter removed from the housing.

The filter retention assembly 208 comprises a catch 214 arranged to engage the filter 204 when the filter retention assembly 208 is in a locked position, as shown in FIG. 4. The catch 214 is arranged to disengage from the filter 204 upon actuation via the user interface 210, as shown in FIG. 5. The catch 214 is disposed on the housing 202. The filter frame 216 is located at an upper edge of the filter medium 205 and is provided with a rim 218 that is arranged to be engaged by the catch 214. In the embodiment shown in the Figures, the rim 218 extends around a top edge of the filter 204 to form a circle, as best shown in FIG. 6, allowing the filter 204 to be located in the housing 202 at any angle of rotation about the longitudinal axis 206. It will be understood that in other embodiments, the rim 218 may have a shorter arc length and extend only partially around the filter 204, whilst still allowing engagement between the filter frame 216 and the catch 214.

The filter retention assembly 208 is biased towards the locked position by a spring 220, to ensure automatic engagement between the catch 241 and the filter frame 216 when the filter 204 is slid into the housing 202 by a user.

Upon actuation of the filter retention assembly 208 via the user interface 210, the filter 204 is free to slide relative to the housing 202. The filter 204 slides in a direction relative to the housing 202, as shown by arrow Y in FIGS. 5 and 6, parallel to the longitudinal axis 206 of the filter assembly 200 and along a length of the filter 204. The housing 202 comprises an aperture (not shown) through which the filter 204 passes to remove the filter 204 from the housing. The aperture is positioned on an underside of the housing 202 to allow the filter 204 to slide under gravity relative to the housing 202 upon release from the filter retention assembly 208, such that the filter 204 can be released from the housing 202 without a user making contact with the filter 204. For example, a user may hold the filter assembly 200 above a bin, then press the user interface 210 to release the filter 204, which falls under gravity into the bin.

Figure 7:
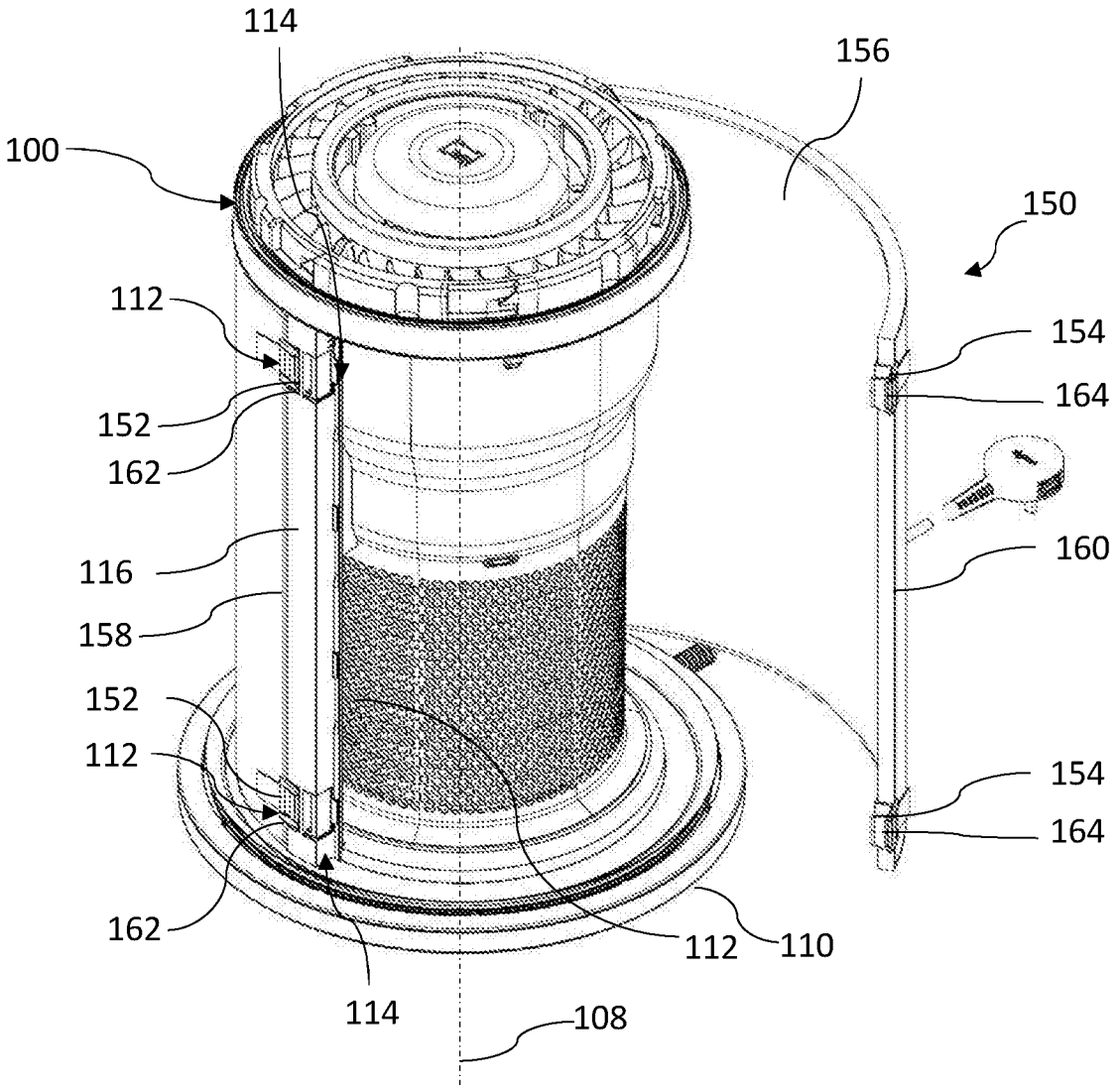
FIG. 7 is an isometric view of the fan assembly of FIG. 1 with the filter assembly removed.

The fan assembly 10 comprises a further filter assembly 150 attached to the fan body 100. The further filter assembly 150 is furlable so as to wrap around the fan body 100 to cover the inlet surface 102, as shown in FIG. 7, which shows the further filter assembly 150 having been wrapped part of the way around the fan body 100. The further filter assembly 150 substantially surrounds the fan body 100 when in place on the fan body 100 so as to cover the inlet surface 102.

The further filter assembly 150 comprises a flexible filter media 156. The filter media 156 is a carbon filter media for purifying air before the air enters the air inlet 104. The filter media 156 is arranged to cover the array of apertures 106 defined in the inlet surface 102.

The fan body 100 comprises two first retention assemblies 112 and two second retention assemblies 114, and the further filter assembly 150 comprises two first engagement elements 152 and two second engagement elements 154, each for engagement with the respective retention assemblies 112, 114. The first engagement elements 152 are positioned at opposite ends of a first edge 158 of the filter media 156 and the second engagement elements 154 are positioned at opposite ends of a second edge 160 of the filter media 156. When the retention assemblies 112, 114 and engagement elements 152, 154 are engaged, the further filter assembly 150 is retained tautly over the inlet surface 102 in a partially unfurled state such that the further filter assembly 150 is tautly wrapped over the inlet surface 102. This helps to ensure that airflow drawn through the air inlet 104 by the motor-driven impeller 14 is drawn through the filter media 156. The use of the retention assemblies 112, 114 and engagement elements 152, 154 negates the need for a more conventional frame to support the flexible filter media 156.

The two first retention assemblies 112 are longitudinally aligned in relation to one another with respect to the central axis 108 of the fan body 100. The two second retention assemblies 114 are longitudinally aligned in relation to one another with respect to the central axis 108 of the fan body 100. The fan body 100 comprises a longitudinal channel 116 extending from the top to the bottom of the fan body 100 and parallel to the central axis 108 of the fan body 100. The retention assemblies 112, 114 are provided within the longitudinal channel 116 such that the first and second the retention assemblies 112, 114 are positioned adjacent to one another and the further filter assembly 150 wraps around substantially all of the fan body 100.

The inlet surface 102 has a smaller radius than a top and bottom of the fan body 100. This creates a void [112] between the longitudinal channel 116 and the inlet surface 102, and thus between the further filter assembly 150 and the inlet surface 102. This allowing for a 360-degree air inlet 104, which provides a more even load to the motor-driven impeller 114 to improve performance of the fan assembly 10 and to reduce noise produced by the fan assembly 10 in use.

The first and second engagement elements 152, 154 each comprise a rigid moulding 162, 164 secured to a respective edge 158, 160 of the filter media 156. The rigid mouldings 162, 164 may be secured to the filter media 156 with glue. The rigid mouldings 162, 164 transfer force applied to the further filter assembly 150 by a user to the fan body 100, rather than the force transferring through the filter media 156 to the fan body 100, which could damage the filter media 156. The rigid mouldings 162, 164 and the respective engagement elements 152, 154 are each monolithic.

Figure 8:
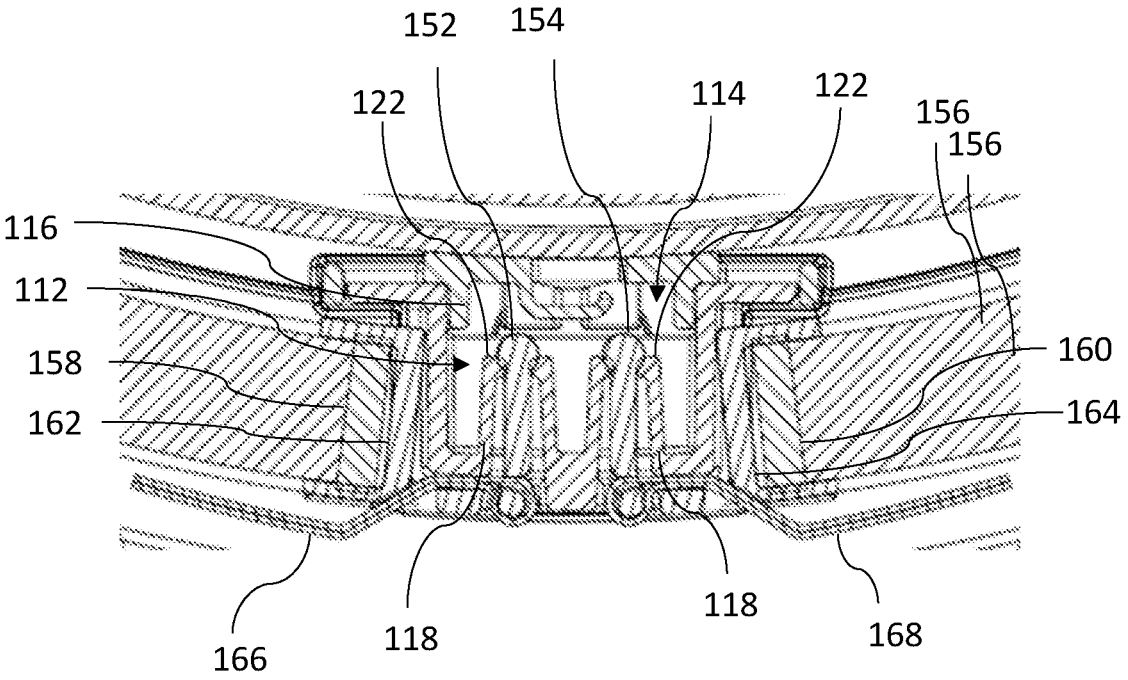
FIG. 8 is a sectional top view of a release mechanism of the fan assembly of FIG. 1.
Figure 9:
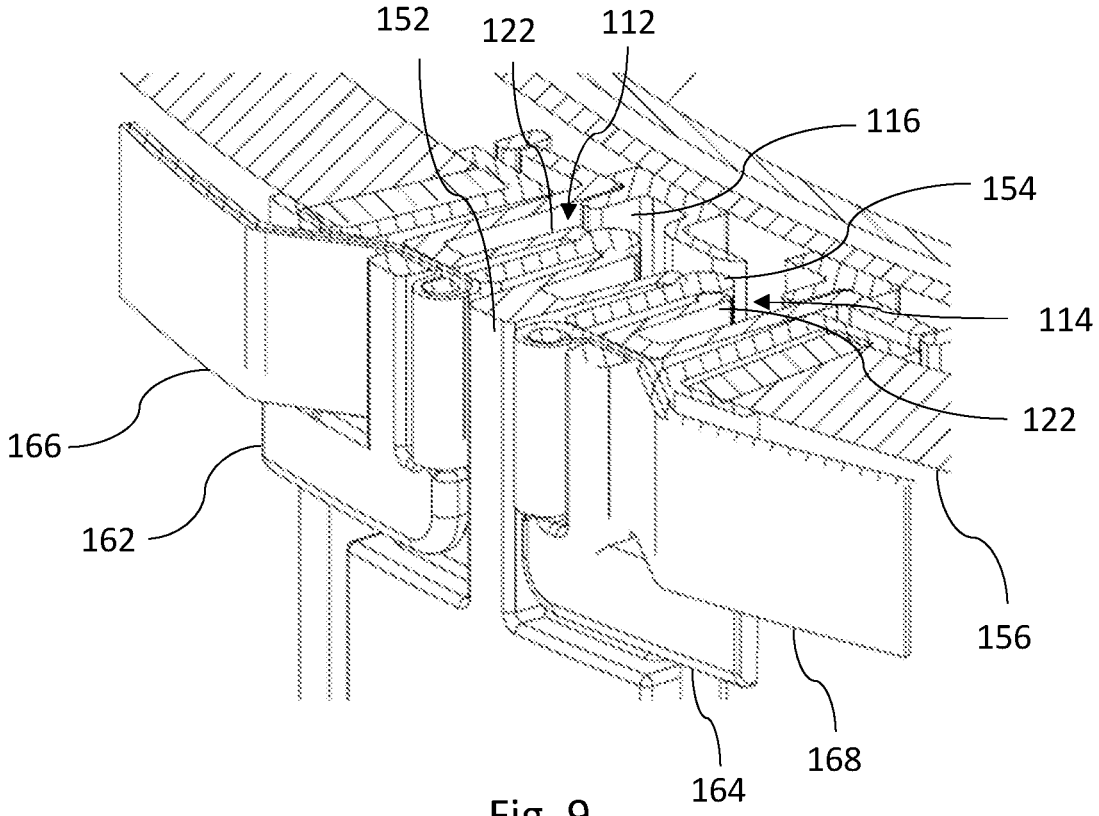
FIG. 9 is an isometric view of the release mechanism of FIG. 8.

FIGS. 8 and 9 shows the first and second retention assemblies 112, 114, and the first and second engagement elements 152, 154 in an engaged position. The first and second retention assemblies 112, 114 comprise respective apertures 118 which extend in a radial direction to receive the respective engagement elements 152, 154 in a radial direction of the fan body 100, such that the edges 158, 160 of the filter media 156 are pushed by a user in the radial direction of the fan body 100 to engage the engagement elements 152, 154 with the retention assemblies 112, 114.

The first and second retention assemblies 112, 114 each comprise a pair of detents 122 arranged to releasably retain the respective engagement element 152, 154 between the pair of detents 122 until application of a force by a user.

The further filter assembly 150 comprises first and second release tabs 166, 168 secured to respective first and second engagement elements 152, 154, as best shown in FIGS. 8 and 9. The first and second engagement elements 152, 154 are each arranged to be released from a respective retention assembly 112, 114 upon application of a force to the respective release tab 166, 168 by a user. The release tabs 166, 168 are formed from fabric and are flexible so that they can lay flat against the rigid mouldings 162, 164 when the filter assembly 200 is engaged with the fan body 100.

The filter assembly 200 is arranged to cover the further filter assembly 150 to provide two-stage airflow filtration upstream of the air inlet 104. The further filter assembly 150 and the filter 204 are independently replaceable by a user, which is particularly advantageous should the lifespans of the further filter assembly 150 and the filter 204 differ.

The fan body 100 comprises a radial flange 110 at a lower end of the fan body 100 which acts as a stop for the filter assembly 200, to ensure the filter assembly 200 is correctly positioned with respect to the inlet surface 102 when engaged with the fan body 100. That is, the filter assembly 200 abuts the radial flange 110 when engaged with the fan body 100 to prevent unfiltered airflow from reaching the air further filter assembly 150. When wrapped around the fan body 100, a lower edge of the further filter assembly 150 abuts the radial flange 110 to prevent unfiltered airflow from reaching the air inlet 104. The lower end of the fan body 100 is defined as a lower end of the fan body 100 when the fan body 100 is correctly orientated for use.

Figure 10:
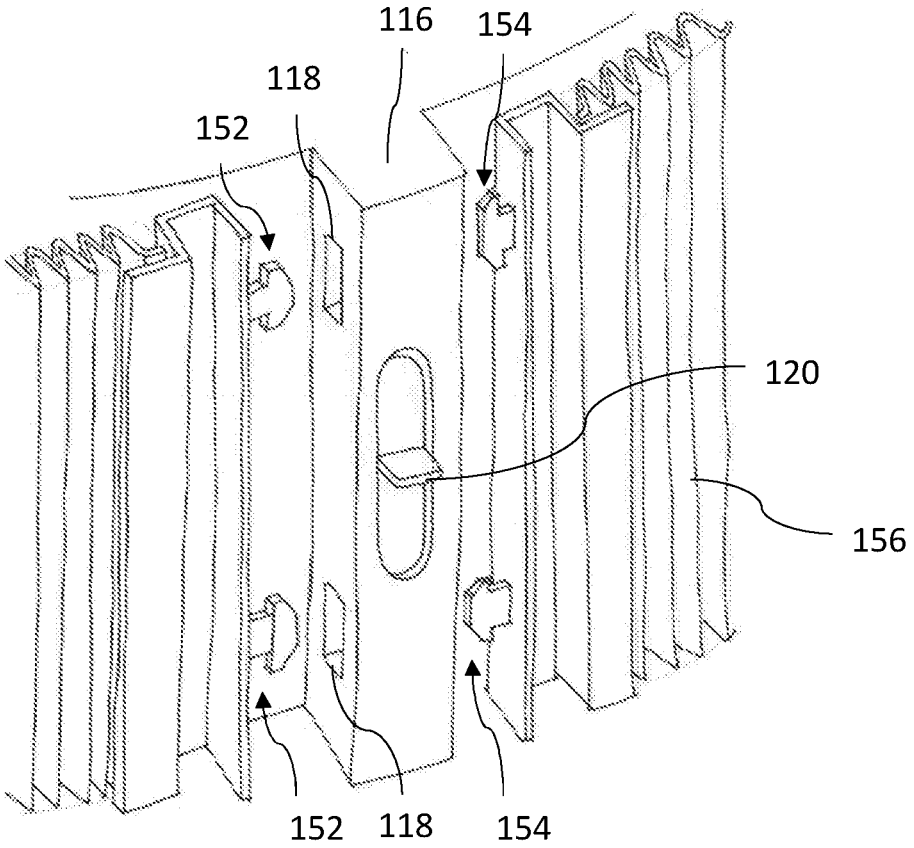
FIG. 10 is an isometric view of an alternative release mechanism according to the present invention.
Figure 11:
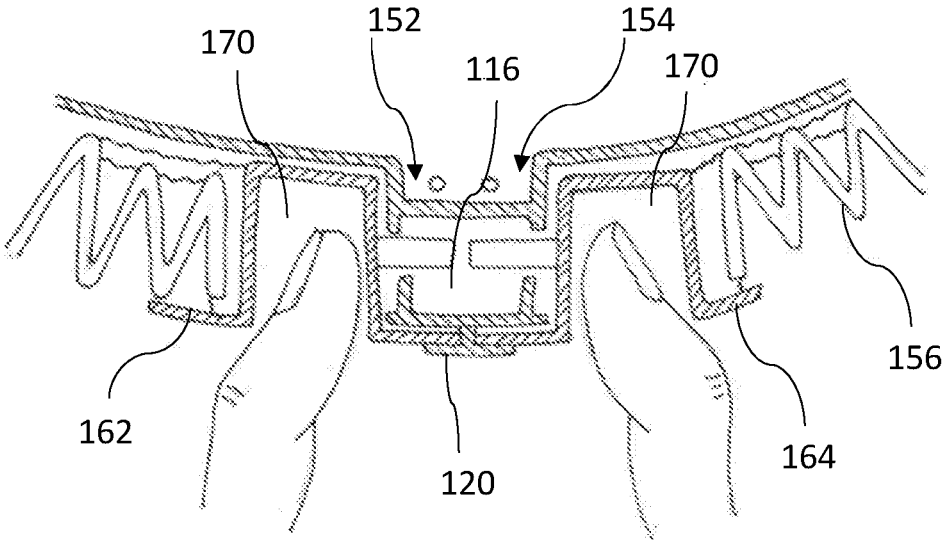
FIG. 11 is a sectional top view of the release mechanism of FIG. 10.

FIGS. 10 and 11 show an alternative embodiment in which first and second retention assembly 112, 114 and a first and second engagement element 152, 154 are in an engaged position. All features of this embodiment other than those described below are the same as the embodiment shown in FIGS. 1 to 9. In this embodiment, the apertures 118 extend through sidewalls of the longitudinal channel 116 in a tangential direction to receive the respective engagement elements 154, 152 in a tangential direction of the fan body 100 such that the edges 158, 160 of the filter media 156 are pushed by a user in the tangential direction of the fan body 100 to engage the engagement elements 152, 154 with the retention assemblies 112, 114.

In this embodiment, the rigid mouldings 162, 164 comprise an outward-facing recess 170 for receiving a user's finger, thus allowing the user to apply a tangential force without deforming the filter media 156. The rigid mouldings 162, 164 extend along the length of the respective edge of the filter media 156.

In this embodiment, the fan body 100 comprises a release switch 120 actuable by a user to release the first and second engagement elements 152, 154 from the respective first and second retention assemblies 112, 114. The release switch 120 is positioned on the longitudinal channel 116 for easy and intuitive use by a user.

Other embodiments of the invention are envisaged which fall within the scope of the invention. For example, an embodiment in which the further filter assembly 150 is releasably engaged with the filter assembly 200 rather than the fan body 100, or in which two or more filter assemblies 150 are employed to surround the fan body 100.

The invention claimed is:

1. A fan assembly comprising:

a fan body comprising an inlet surface defining an air inlet;

a motor-driven impeller contained within the fan body and arranged to generate an airflow; and a filter assembly arranged to removably engage with the fan body and to cover at least a portion of the inlet surface when engaged with the fan body, wherein the filter assembly comprises a filter and a housing for the filter, the housing being provided with a filter retention assembly for releasably retaining the filter in the housing and a user interface for actuating the filter retention assembly to release the filter from the housing, wherein the user interface is positioned on a radially facing inner surface of the housing, and wherein, upon actuation of the filter retention assembly via the user interface, the filter is free to slide relative to the housing.

2. The fan assembly according to claim 1, wherein the radially facing inner surface of the housing faces the fan body when the filter assembly is engaged with the fan body.

3. The fan assembly according to claim 1, wherein the user interface is inaccessible by a user when the filter assembly is engaged with the fan body.

4. The fan assembly according to claim 1, wherein, upon actuation of the filter retention assembly via the user interface, the filter is arranged to slide under gravity relative to the housing.

5. The fan assembly according to claim 1, wherein the filter assembly comprises two filter release assemblies and two corresponding user interfaces, the two user interfaces being disposed at the same end of the housing as each other.

6. The fan assembly according to claim 1, wherein the filter retention assembly comprises a catch arranged to engage the filter when the filter retention assembly is in a locked position and to disengage from the filter upon actuation via the user interface.

7. The fan assembly according to claim 6, wherein the filter comprises a filter medium and a filter frame at an edge of the filter medium, and the filter frame is provided with a rim that is arranged to be engaged by the filter retention assembly.

8. The fan assembly according to claim 1, wherein the filter assembly has a closed cross-sectional shape and is arranged to be concentric with the fan body when engaged with the fan body.

9. The fan assembly according to claim 1, wherein the fan body is substantially cylindrical, and the filter assembly extends circumferentially around the fan body when the filter assembly is engaged with the fan body.

10. The fan assembly according to claim 9, wherein the filter assembly extends more than 180 degrees around the fan body when the filter assembly is engaged with the fan body.

11. The fan assembly according to claim 10, wherein the filter assembly is tubular, and the filter surrounds a majority of the fan body when the filter assembly is engaged with the fan body.

12. The fan assembly according to claim 1, wherein the filter is slidable relative to the housing in a direction parallel to a longitudinal axis of the filter assembly, the longitudinal axis of the filter assembly being co-axial with a central axis of the fan body with the filter assembly is engaged with the fan body.

13. The fan assembly according to claim 1, wherein the filter assembly is slidable relative to the fan body in a direction parallel to the central axis of the fan body to disengage the filter assembly from the fan body.

14. The fan assembly according to claim 1, wherein the housing comprises plurality of apertures to allow airflow to pass through the housing and the filter.

15. The fan assembly according to claim 1, comprising a further filter releasably attached to the fan assembly to cover the inlet surface, wherein the filter assembly is arranged to cover the further filter such that the filter is positioned upstream of the further filter.

* * * * *